US007978872B2

(12) United States Patent
Dam

(10) Patent No.: US 7,978,872 B2
(45) Date of Patent: Jul. 12, 2011

(54) DRIVER FOR A SPEAKER

(75) Inventor: Vu-Quang Dam, Chiayi (TW)

(73) Assignee: DK Signal Ltd., Chiayi (TW)

( * ) Notice: Subject to any disclaimer, the term of this patent is extended or adjusted under 35 U.S.C. 154(b) by 1099 days.

(21) Appl. No.: 11/797,785

(22) Filed: May 8, 2007

(65) Prior Publication Data

US 2008/0187167 A1 Aug. 7, 2008

(30) Foreign Application Priority Data

Feb. 6, 2007 (TW) ..... 96202277 U

(51) Int. Cl.
*H04R 1/00* (2006.01)
*H04R 1/20* (2006.01)
*H04R 9/06* (2006.01)
*H04R 11/02* (2006.01)

(52) U.S. Cl. ..... 381/396; 381/340

(58) Field of Classification Search ..... 381/151, 381/152, 339, 340, 396, 412–414; 310/81
See application file for complete search history.

(56) References Cited

U.S. PATENT DOCUMENTS 4,031,337 A * 6/1977 Okamura et al. ..... 381/340
4,514,599 A * 4/1985 Yanagishima et al. ..... 381/152
5,253,301 A * 10/1993 Sakamoto et al. ..... 381/89
5,987,148 A * 11/1999 Hsieh ..... 381/397

FOREIGN PATENT DOCUMENTS

TW 375346 11/1999

* cited by examiner

*Primary Examiner* — Tuan D Nguyen
(74) *Attorney, Agent, or Firm* — Bacon & Thomas, PLLC

(57) ABSTRACT

A driver for a speaker including: an upper housing, a lower housing and a vibration device, wherein said upper housing combines with said lower housing to form a chamber therein. The vibration device is received in the chamber. The vibration device is basically constituted with an acoustic phase equalizer, a diaphragm, a flux guiding plate, a magnet and a yoke. By the design of the flux guiding plate, the magnet and the yoke in present invention, the disadvantage of highly concentrated heat in prior art can be improved and extends the operation period.

6 Claims, 2 Drawing Sheets

DRIVER FOR A SPEAKER

BACKGROUND OF THE INVENTION

1. Field of the Invention

The present invention relates to a speaker, more particularly to a driver for driving a speaker.

2. Description of the Related Art

A permanent magnet and a diaphragm with a coil are used as a driver for speaker in prior art usually. By the magnetism that generates by the electrified coil is the same as or the different from the magnetism of the permanent magnet, the repulsion or the attraction will cause the diaphragm to generate a sound.

The structures of the driver that has a rare earth magnet therein use the rare earth magnet to replace the permanent magnet and reduce the chamber as disclosed in Taiwan Patent 375346. Even though the change shrinks the chamber but still generates the same heat. Because that the heat transmits by air in this prior art patent and the holes for airflow not communicate to each other, the heat will gather up at some place. The heat cannot transmit through out the shell efficiently and causes the temperature inside the driver rose. The diaphragm will deform in the high-temperature environment for a long period and shorten the operation period of the speaker.

As aforesaid, there is a disadvantage that needs to improve in the speaker of the prior art.

SUMMARY OF THE INVENTION

The object of the present invention is to provide a driver for a speaker, which can increase the radiation efficiency of the driver for a speaker and operation period also.

To achieve this object of the present invention, the driver for speaker of present invention including: an upper housing, a lower housing and a vibration device. The vibration device is received in the chamber. The vibration device is basically constituted with an acoustic phase equalizer, a diaphragm, a flux guiding plate, a magnet and a yoke. There is a hole provided on each center of the yoke, the magnet and the flux guiding plate. So, the heat can circulate therein. By the way, present invention can increase the radiation efficiency and protects the diaphragm and increases the operation period by the design of the structures as aforesaid.

DETAILED DESCRIPTION OF THE INVENTION

Figure 1:
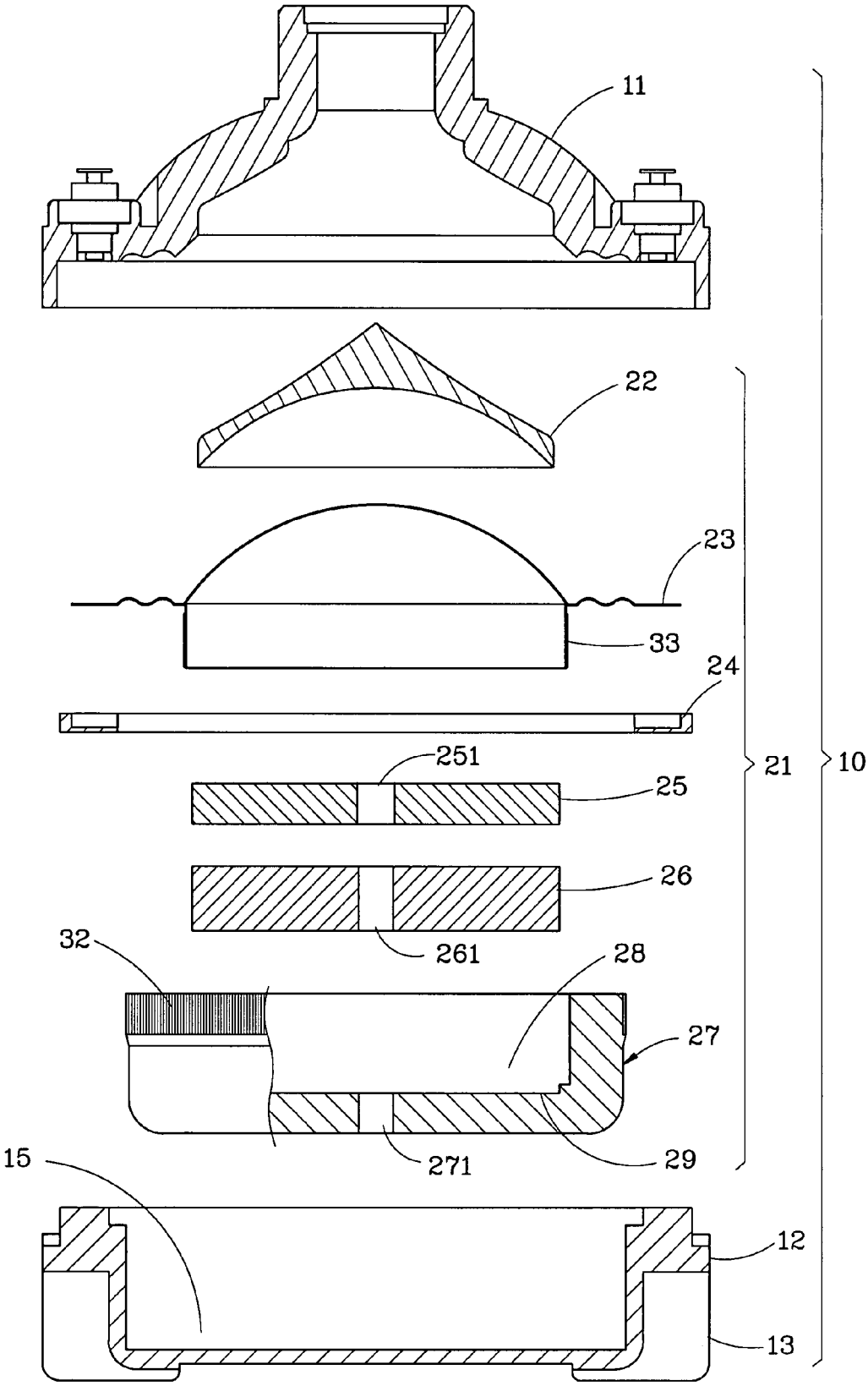
FIG. 1 is an exploded view of the present invention.
Figure 2:
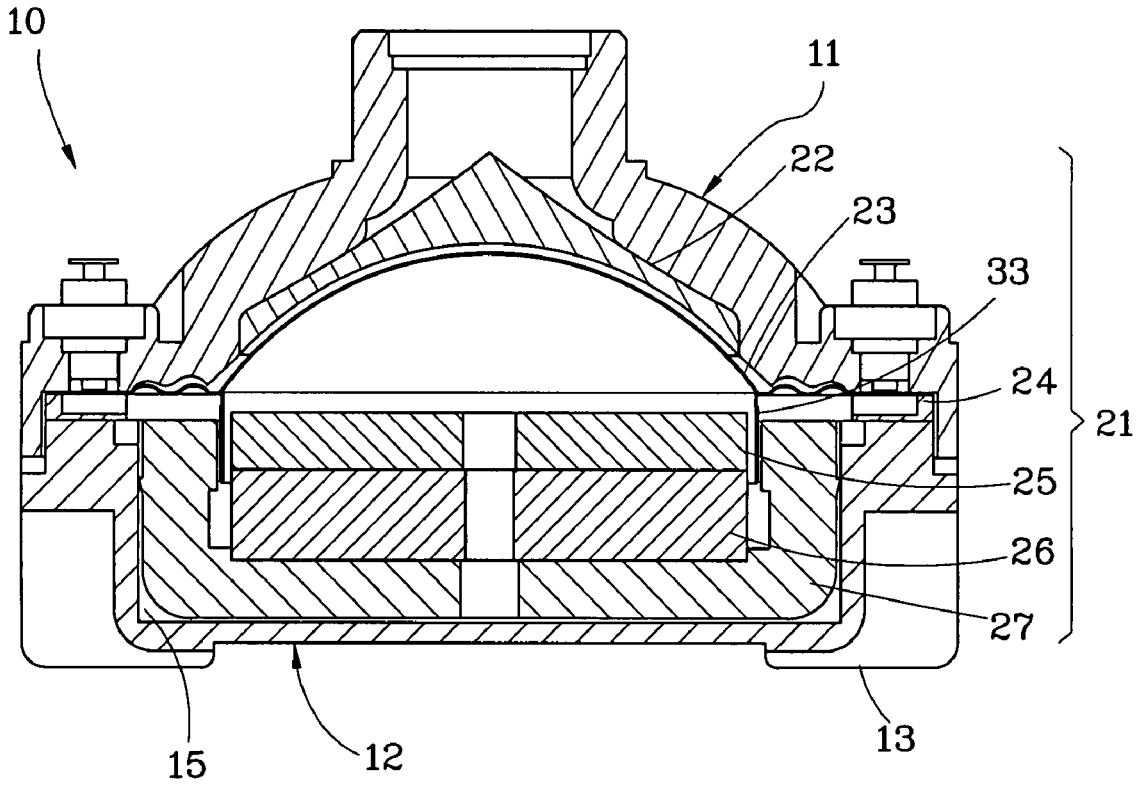
FIG. 2 is a combination view of the present invention, which is showing the combination status of every parts of the driver for speaker.

Referring to FIG. 1 to 2, the driver for a speaker of present invention including: an upper housing 11, a lower housing 12 and a vibration device 21.

There is a plurality of dissipating fins 13 provided on the outside surface of said lower housing 12.

Said lower housing 12 has a cavity. Said upper housing 11 can combine with said lower housing 12 to from a chamber 15 therein.

Said vibration device 21 is received in said chamber 15. Said vibration device 21 is constituted with an acoustic phase equalizer 22, a diaphragm 23, an annular flange 24, a flux guiding plate 25, a magnet 26 and a yoke 27 basically.

There is a hole 271 provided on the center of said yoke. Said magnet 26 provides a hole 261 at the center thereon, and said flux guiding plate 25 provides a hole 251 at the center thereon also. Those three holes communicate to each other.

Said yoke 27 provides a recess 28 from top to bottom. Said magnet 26 and said flux guiding plate 25 are received in said recess 28. There is a predetermined distance between the edges of said magnet 26 and the inner surrounding wall of said recess 28, and there is a predetermined distance between the edge of said flux guiding plate 25 and the inner surrounding wall of said recess 28 also. The bottom of said recess 28 provides a fixed pit 29 to limit said magnet 26 and make said magnet 26 to stay at the center of said recess 28. When said yoke 27, said magnet 26 and said flux guiding plate 25 are fixed at the center, the hole 271 on said yoke 27, the hole 261 on said magnet 26 and the hole 251 on said flux guiding plate 25 communicate to each other. A flange 32 extrudes from the topside of said yoke 27. There is a plurality of vertical ribs provided on the outside wall of said flange 32.

Said yoke 27 joins with said lower housing 12 tight by the outside wall of said flange 32. When said yoke 27 joins with said lower housing 12, a gap will be formed therein, and there is a predetermined distance between said lower housing 12 and the outside bottom of said yoke 27.

An annular extension 33 sets up on the bottom of said diaphragm 23. Said annular extension 33 covers on the outside wall of said flux guiding plate 25 and make said annular extension 33 placed between the inside wall of said yoke 27 and the outside wall of said flux guiding plate 25. Said annular extension 33 has a voice coil therein.

When the driver for speaker is fabricated, the bottom side of said upper housing 11 connects with said acoustic phase equalizer 22. Said diaphragm 23 adjoins said acoustic phase equalizer 22. A fixed annular 24 is installed on the outside flange of said diaphragm 23 for fixing said upper housing 11, said diaphragm 23 and said lower housing 12 together. Said diaphragm 23 covers on said flux guiding plate 25 and said magnet 26 by said annular extension 33, which is inside said yoke 27. Said yoke 27 just lodges in said lower housing 12 with the upside outer wall surface of said flange 32.

The electrified annular extension 33 will generate a magnetic force. The magnetic force will attract or repulse the magnetism of said magnet 26 and cut across the magnetic field, and causes said diaphragm 23 to vibrate and generates a sound. The driver for speaker reaches the object of driving a speaker. When the magnetic force cuts across the magnetic field, said magnet 26, said flux guiding plate 25 and said yoke 27 will generate heat. Due to the hole 271 on said yoke 27, the hole 261 on said magnet 26 and the hole 251 on said flux guiding plate 25 communicate to each other, the heat airflow circulates along with the gap between said yoke 27 and said lower housing 12 and those holes 251, 261, 271. The heat will be transmitted into said chamber 15 finally. So, the heat will not highly concentrated gathers up at some place. The inside of said driver for a speaker 10 can be kept in normal operation temperature.

As aforesaid, the driver for speaker of present invention really can transmit the heat uniformly and reduces the temperature inside said driver for a speaker and protects the diaphragm 23, and increases the operation period. So, present invention can erase the inconvenience and persecution in operation of prior art. Depending on the patent law, the applicant files the application.

Those structures of present invention as aforesaid are only for illustration and not for limiting the scope of claims. It should be take as in the scope of present invention by every equivalent replacement.

What is claimed is:

1. A driver for a speaker, including:

an upper housing and a lower housing, said upper housing combining with said lower housing to form a chamber therein;

a vibration device being received in said chamber and said vibration device being constituted with an acoustic phase equalizer, a diaphragm, a flux guiding plate, a magnet and a yoke; said yoke providing a recess from top to bottom and said magnet and said flux guiding plate being placed in said recess in order; a flange extruding from the topside of said yoke with predetermined thickness; said yoke lodging in said lower housing and there being a hole provided on each center of the yoke, the magnet and the flux guiding plate, and those three holes communicating to each other.

2. The driver as claimed in claim 1, wherein there is a predetermined distance between the edges of said magnet and the inner surrounding wall of said recess, and there is a predetermined distance between the edge of said flux guiding plate and the inner surrounding wall of said recess also.

3. The driver as claimed in claim 1, wherein the bottom of said recess provides a fixed pit and the shape of said fixed pit limits the bottom side of said magnet and make said magnet to stay at the center of said recess.

4. The driver as claimed in claim 1, wherein there is a plurality of dissipating fins provided on the outside surface of said lower housing.

5. The driver as claimed in claim 1, wherein an annular extension sets up on the bottom of said diaphragm; said annular extension that has a voice coil therein covers on the magnet and is placed between the inside wall of said yoke and the outside wall of said flux guiding plate.

6. The driver as claimed in claim 1, wherein said yoke join with said lower housing tight by the outside wall of said flange and there is a predetermined distance between said lower housing and the outside bottom of said yoke.

* * * * *